United States Patent [19]

Grimsley

[11] 4,378,661

[45] Apr. 5, 1983

[54] APPARATUS FOR HOLDING VALVE ELEMENT AND REFINISHING TOOL

[76] Inventor: Ernest E. Grimsley, 4533 Wake Forest Rd., Portsmouth, Va. 23703

[21] Appl. No.: 154,357

[22] Filed: May 29, 1980

[51] Int. Cl.[3] ..... B24B 15/00

[52] U.S. Cl. ..... 51/125; 51/241 VS; 51/216 R; 408/83.5; 409/225; 279/5

[58] Field of Search ..... 51/216 R, 216 T, 216 P, 51/216 A, 217 R, 217 P, 217 T, 217 A, 218 R, 218 A, 218 P, 218 T, 125, 240 R, 240 A, 98 R, 109 R, 241 VS; 279/110, 112, 1 A, 5; 409/225; 408/83.5

[56] References Cited

U.S. PATENT DOCUMENTS

| | | | |
|---|---|---|---|
| 671,252 | 4/1901 | Weatherby | 279/112 |
| 824,321 | 6/1906 | Williams | 408/83.5 |
| 2,332,394 | 10/1943 | Norton | 408/83.5 |
| 2,372,341 | 3/1945 | Shanley | 51/241 A |
| 2,383,755 | 8/1945 | Wilcox | 51/217 R |
| 2,417,737 | 3/1947 | Culp | 51/111 R |
| 2,743,556 | 5/1956 | Van Steenberg | 51/125 |
| 4,205,495 | 6/1980 | Grimsley | 51/241 VS |

OTHER PUBLICATIONS

Towlson, J. T., "To Hold Small Bars in a Chuck-Discussion" Am. Mach., vol. 58, No. 22, May 31, 1923.

*Primary Examiner*—Roscoe V. Parker

*Attorney, Agent, or Firm*—Griffin, Branigan & Butler

[57] ABSTRACT

A wedge-shaped gate valve element (12) is held by a portable apparatus (10) in proximity to a tool (14) for refinishing sloped surfaces (16) of the element (12). The element (12) is gripped by a vise (92) which, in turn, is rigidly mounted to a vise support (86). The vise support (86) is mounted on a frame (17) of the apparatus. A support surface (90) of the vise support (86) is suitably inclined to give an upper sloped surface (16a) of element (12) a desired orientation with respect to the refinishing tool (14) which is also held in position on the apparatus (10).

8 Claims, 4 Drawing Figures

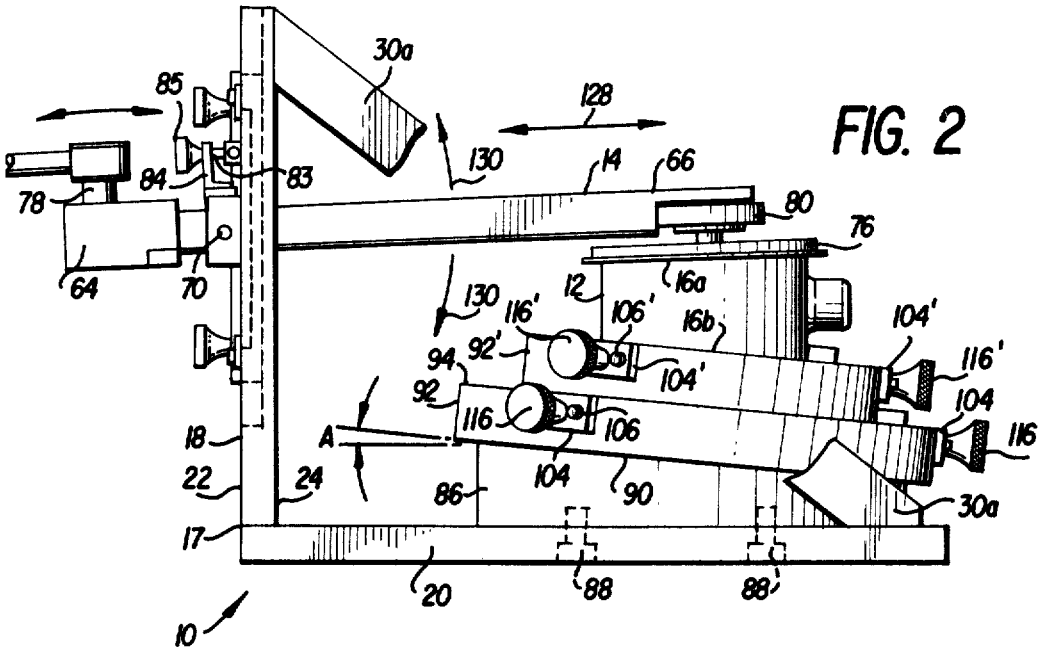
FIG. 2
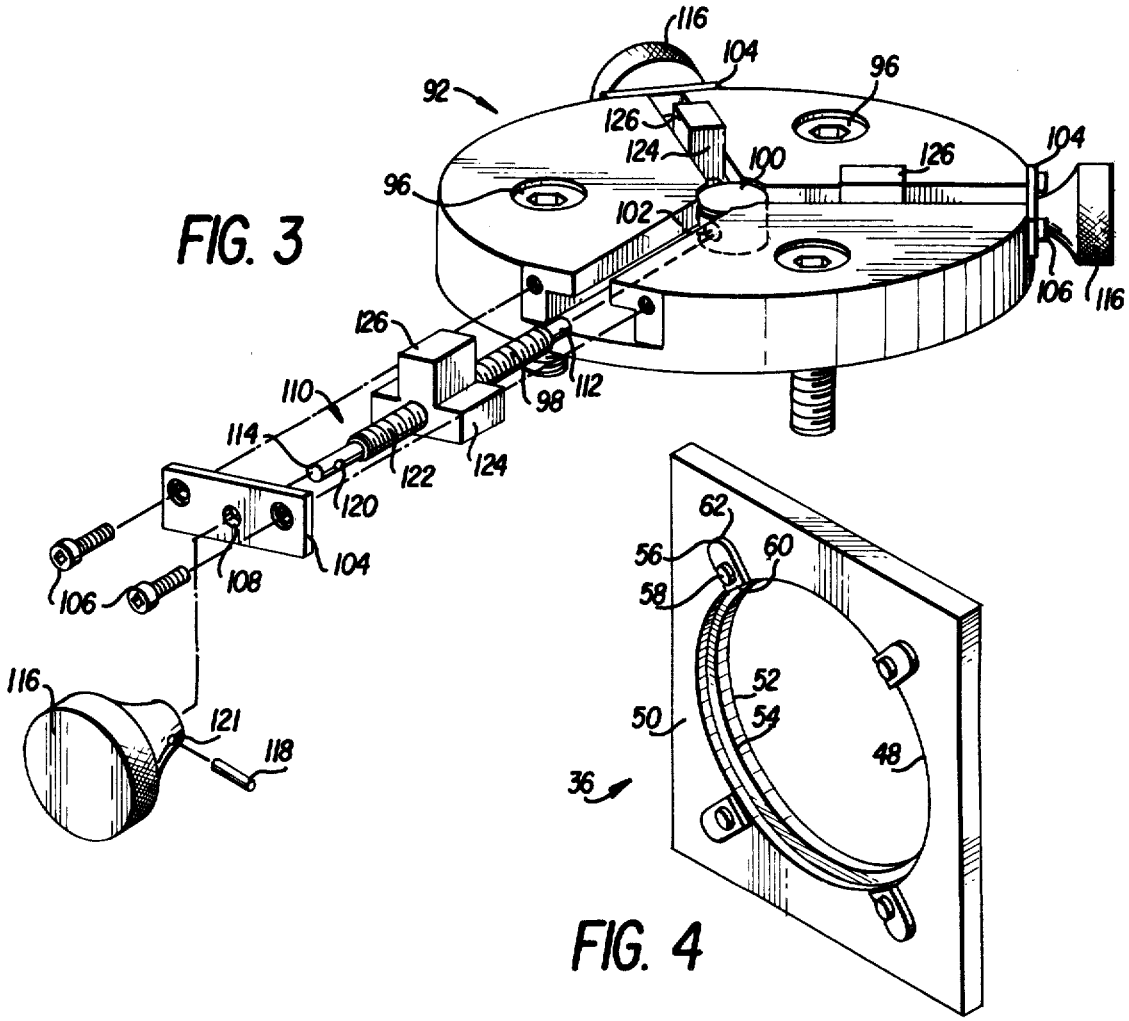
FIG. 3
FIG. 4

APPARATUS FOR HOLDING VALVE ELEMENT AND REFINISHING TOOL

BACKGROUND OF THE INVENTION

This invention relates to work and tool holders, and particularly concerns an apparatus for refinishing sloped surfaces of wedge-shaped gate valve elements.

Gate valves typically comprise a wedge-shaped valve element or gate positionable between two opposed annular seating surfaces. Sloped surfaces of the wedge-shaped element, as well as the seating surfaces, frequently require refinishing because of corrosion or wear. U.S. patent application Ser. No. 840,453 (filed Oct. 7, 1977 and abandoned in favor of U.S. patent application 004,125, filed Jan. 17, 1979, now U.S. Pat. No. 4,205,495 incorporated herein by reference, discloses a compact tool of small weight for refinishing the seating surfaces of gate valves. Basically, the tool comprises an abrasive means mounted by a swivel joint which is rotatably driven. An external power source imparts rotational motion to a drive train contained in a pivotal housing element for ultimately rotating the swivel joint and abrasive means. The tool is insertable into the gate valve (after the valve operating mechanisms, including the wedge-shaped valve element, have been removed) so that the abrasive element thereof is in proximity to the annular valve seating surfaces to be refinished.

Since gate valves are often utilized in high pressure environments, the wedge-shaped valve elements employed therein are frequently of a very hard and weighty composition, such as Stellite, for example. In order to refinish the sloped surfaces of such an element, the element must be securely mounted in a durable and sturdy work holder. However, presently known holders are quite bulky, heavy, and provide no convenient and precise way of appropriately orienting the sloped surface of a valve element with respect to a refinishing tool.

SUMMARY

The present invention provides a portable work and tool holding apparatus which facilitates the refinishing of sloped surfaces of wedge-shaped gate valve elements. The apparatus comprises a frame having a first plate which is essentially erect and orthogonal with respect to a base plate. The first plate includes a slidable tool support member for selectively varying the distance of the refinishing tool mounted thereon from the base plate. The tool is pivotally mounted in the tool support member so that it is rotatable about an axis in the plane of the first plate.

Mounted on the base plate is a vise support which has an upper support surface inclined at an angle with respect to the base plate. For fairly large valve elements a vise comparable in size to the inclined support surface is rigidly mounted thereon. The vise grips the wedge-shaped valve element and causes a sloped surface thereof to lie in proximity to an abrasive means of the refinishing tool. The angle of inclination of the support surface of the vise support compensates for the sloped surfaces of the wedge-shaped valve element thus enabling the vise to position the sloped surface being refinished in a desired orientation with respect to the abrasive means of the tool. For refinishing smaller valve elements, a further vise (suitably sized) is mounted on the first vise which remains secured to the vise support.

It is an object of the present invention to provide a lightweight, portable apparatus which rigidly mounts and appropriately orients a wedge-shaped gate valve element in relation to a refinishing tool held by the apparatus.

An advantage of the invention is the provision of a disc-shaped vise for securing the gate valve element to the apparatus and for positioning and centering the element with respect to an abrasive means of the refinishing tool.

A further advantage of the invention is the provision of an apparatus capable of mounting gate valve elements of differing sizes through the provision of a plurality of vises having correspondingly differing sizes by using the valve elements, the vises being mountable one upon another.

Another advantage of the invention is the provision of a vise support member which has an inclined support surface so that a sloped surface of the gate valve element acquires a desired orientation with respect to the refinishing tool.

BRIEF DESCRIPTION OF THE DRAWINGS

The foregoing and other objects, features and advantages of the invention will be apparent from the following more particular description of the preferred embodiments of the invention, as illustrated in the accompanying drawings in which like reference characters refer to the same parts throughout different views. The drawings are not necessarily to scale, emphasis instead being placed upon illustrating the principles of the invention.

FIG. 2 is a side view of FIG. 1;

FIG. 3 is an exploded view of a vise according to one embodiment of the invention; and, FIG. 4 is a perspective view of a tool support member according to one embodiment of the invention.

DETAILED DESCRIPTION OF THE INVENTION

Figure 1:
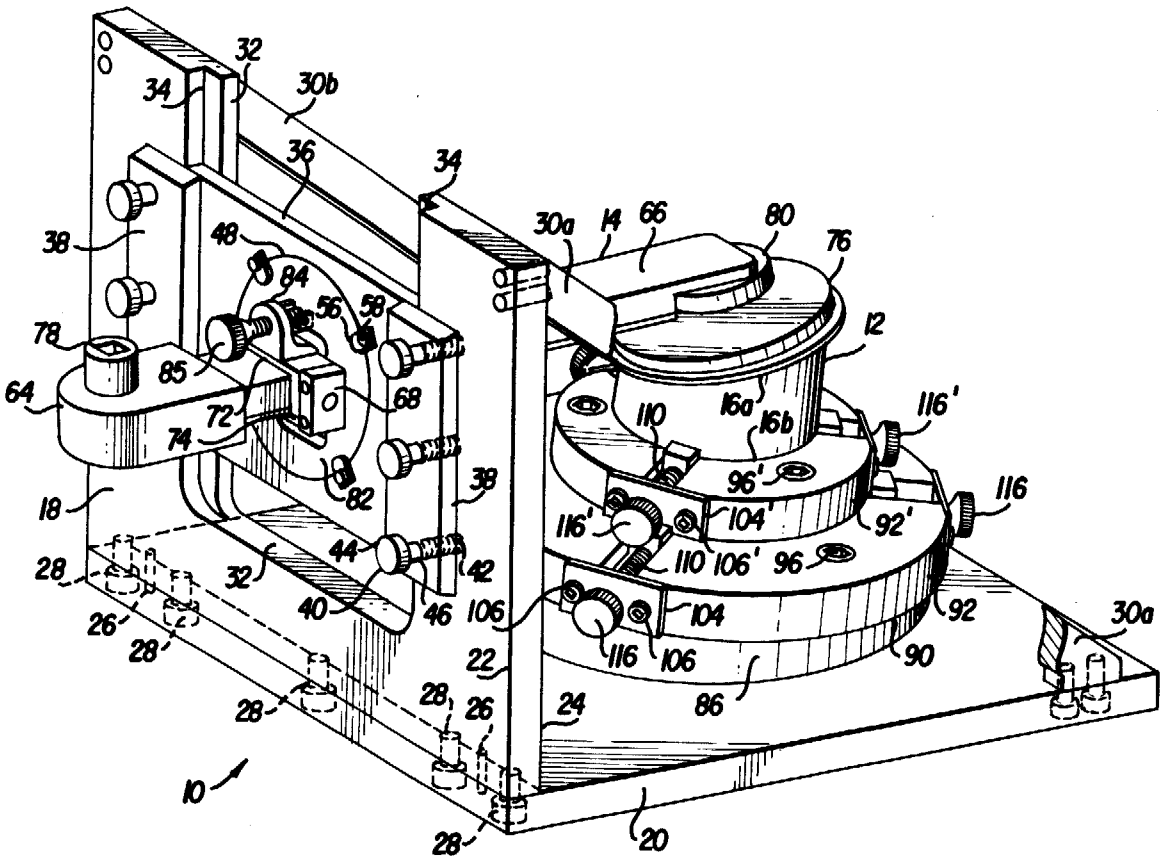
FIG. 1 is a perspective view of one embodiment of the invention.

FIG. 1 illustrates a work and tool holder apparatus 10 wherein a wedge-shaped gate valve element 12 is secured in position with respect to a refinishing tool 14. The refinishing tool 14 grinds or refinishes sloped surfaces 16*a* and 16*b* of the element 12. The apparatus 10 comprises a frame 17 which includes a first plate, or front plate 18, which is vertically erect with respect to a second plate, or base plate 20. The front plate 18 has a first surface 22 and a second surface 24 on the opposite side of the plate.

In the embodiment shown in FIGS. 1 and 2, the front plate 18 and base plate 20 are essentially perpendicular to one another. The front plate 18 is aligned in position on top of base plate 20 by two alignment pins 26. The plates 18 and 20 are secured to one another by appropriate threaded fasteners 28 which enter from beneath base plate 20 and extend upwardly into the front plate 18.

The frame 17 also comprises two brace bars 30*a* and 30*b* which connect the front plate 18 and the base plate 20 in hypotenuse fashion. As illustrated in FIGS. 1 and 2, the brace bar 30*a* is partially broken away to permit viewing of other portions of the apparatus 10.

The front plate 18 has an erect, substantially U-shaped channel 32 extending through the plate 18 from its first surface 22 to its second surface 24. The intersections of the vertical segments of the U-shaped channel 32 with plate surface 22 are indented to form two vertical grooves 34. A tool support member 36 is retained in the grooves 34 by two elongated clamp members 38. Each clamp member 38 is secured to the tool support 36 by threaded fasteners 40. Each fastener 40 comprises a threaded portion 42 (extending into a counter-threaded bore of the plate 18) as well as a knob 44. A washer 46 is positioned intermediate the knob 44 and the clamp 38. By rotation of the knobs 44 each of the threaded fasteners 40 can be selectively loosened and tightened, thereby either loosening or tightening the clamps 38, in order to permit vertical travel of the tool support 36 in the grooves 34.

As seen in FIG. 4, the tool support member 36 has a circular aperture 48 which extends through the member 36 from a first surface 50 to an oppositely disposed second surface 52. However, an annular retaining portion 54 flush with surface 52 protrudes into the aperture 48 so that the diameter of the aperture 48 at the second surface 52 is less than at the first surface 50.

Retainer elements 56 are mounted around the circumference of the aperture 48 on surface 50 of the tool support member 36. Each retainer element 56 is attached to the tool support member 36 by a fastener 58. Each retainer element 56 has both a flat surface 60 and a curved surface 62. Curved surface 62 extends away from the fastener 58 at a greater distance than the distance separating the fastener 58 and the circumference of aperture 42. Flat surface 60, on the other hand, is separated from the fastener 58 by a lesser distance than is the circumference of aperture 42.

FIGS. 1 and 2 both illustrate the refinishing tool 14 which is disclosed in copending U.S. patent application Ser. No. 840,453, already incorporated herein by reference. The refinishing tool 14 comprises a housing and support means which includes a housing 64, an elongated support arm 66, first and second support blocks 68, first and second pins 70 (only one shown in FIG. 2) and a clamping means including first and second clamping elements 72 and 74.

The refinishing tool 14 also comprises an abrasive means 76 which is rotated by a drive means. Although not detailed as such in the drawings, the abrasive means 76 preferably comprises a pressure plate or disc having a sheet of abrasive material glued or otherwise affixed to one surface thereof. The drive means includes an input drive shaft 78 on the housing 64, two pulleys linked by a belt (contained in the elongated support arm 66), and a swivel joint (indicated generally as 80).

A circular tool base plate 82 is mounted on the support block 68 of tool 14 by appropriate fastening means (not illustrated). A threaded shaft 83 is hinged at one end to the tool base plate 82. The shaft 83 extends from the base plate 82 and through a hole in a bracket 84 which is welded or otherwise affixed to first clamping means 72. The other end of the shaft 83 has a rotatable, internally counter-threaded knob 85 riding thereon.

When the retainer elements 56 of tool base plate 82 are oriented in the manner depicted in FIG. 4 so that the flat surfaces 60 thereof face the circumference of the aperture 48, the tool base plate 82 snugly fits into the aperture 48 but is prevented from passing completely therethrough by the annular retaining portion 54 of member 36. Once the tool base plate 17 is in place, each retainer element 56 may be rotated so that it acquires the orientation depicted in FIG. 1. That is, the curved surfaces 62 of the elements 58 are rotated so that the surfaces 62 overlap the tool base plate 82. Since the aperture 48 and tool base plate 82 are both circular, the screws 58 may be loosened to permit rotation of the base plate 82 to accomplish tool alignment.

Support blocks 68 are provided with holes for receiving the pivot pins 70. Intermediate the two support blocks 68 is the first clamping element 72, a U-shaped element having arms which are also provided with holes for receiving the pins 70. The second clamping element 74 is a T-shaped element which is attached to the first clamping element 72 by screws (not illustrated). The elongated support arm 66 extends between the arms of the U-shaped element 72 and the element 74. Upon tightening the unillustrated screws, the arm 66 is clamped between elements 72 and 74. This clamping arrangement permits the user to horizontally adjust the arm 66, thereby permitting adjustment of the location of the abrasive means 76.

The base plate 20 has mounted thereon a circular support member 86. The support member 86 is secured to the base plate 20 by a plurality of threaded fasteners 88 which extend upwardly from beneath the base plate 20 into the support member 86. The support member 86 has a support surface 90 which is inclined at an angle A with respect to the base plate 20 (FIG. 2). The angle A is preferrably of the order of 5°.

A first vise member 92 is mounted upon the support surface 90 of the support member 86. In the embodiments shown in the figures, the vise 92 is a disc having a top surface 94. The vise 92 is secured to the support member 86 by a plurality of threaded fasteners 96 which extend from the top surface 94 downwardly into the support member 86.

As seen in FIG. 3, vise 92 has a plurality of radially extending grooves 98 channelled onto the circular top surface 94. In the embodiment shown in the figures, three such grooves 98 are equally spaced around the vise 92. Each groove 98 takes the shape of an inverted T. At the intersection of the grooves at the center of the vise 92 is a circular hub 100 which has three apertures 102, each aperture 102 being aligned with a corresponding groove 98.

A retaining bar 104 covers the opening of the groove 98 at the periphery of the vise 92. The retaining bar 104 is secured to the vise 92 by screws 106. The retaining bar 104 has a circular aperture 108.

Each groove 98 accommodates a cylindrical shaft 110 which has a first end 112 insertable into the vise hub aperture 102 and a second end 114 which protrudes through the retaining bar aperture 108. A knob 116 fits over the second end 114 of each shaft 110 and is secured thereto by a pin 118 which fits through both a hole 120 in the second end 114 of shaft 110 and a hole 121 in the knob 116. Intermediate its first end 112 and second end 114 the shaft 110 has a threaded portion 122.

Each vise groove 98 also accommodates an inverted T-shaped clamp block 124. Each clamp block 124 has an elevated portion 126 which protrudes above the top surface 94 of the vise 92. Each clamp block 124 is bored through and counter-threaded so that the clamp block 124 engages the threaded portion 122 of the shaft 110 for traveling in a radial direction thereon.

Mounted on the top surface 94 of the first vise 92 is a second vise 92' which is identical in all respects with the first vise 92 as illustrated in FIG. 3, except that the second vise 92' has a smaller radius. In this respect, the elements comprising the second vise 92' are indicated in the figures by primed numbers which correspond to the like-numbered unprimed elements of first vise 92. For example, the second vise 92' is secured to the first vise 92 (and not the support member 86) by fasteners 96'.

The wedge-shaped gate valve element 12 is held on the upper surface 94' of the vise 92'. The gate valve element 12 comprises two sloping surfaces 16a and 16b, an upper surface 16a being positioned to face the abrasive means 76. The elevated portion 126 of each clamping block 124 engages the periphery of the gate valve element 12.

In operation, the wedge-shaped gate valve element 12 is placed on the top surface of either vise 92 or vise 92'. If the gate valve element 12 is relatively large, vise 92' is removed and the element 12 is positioned on the top surface 94 of vise 92. The knobs 116 are rotated until the elevated portions 126 of the clamping blocks 124 riding on the shaft 110 engage the periphery of the gate valve element 12. The extent of rotation of each knob 116 affects the positioning and centering of the gate element 12 with respect to the top surface 94 and the abrasive means 76. If, on the other hand, the gate valve element 12 is relatively small, the vise 92' is positioned on the top surface 94 of vise 92 and secured thereto by fasteners 96'. Then, the knobs 116 of vise 92 are rotated so that the elevated portions 126 of the clamp blocks 124 firmly engage the periphery of vise 92'. Thereafter the gate valve element 12 is placed on the upper surface 94' of vise 92'. Knobs 116' are rotated until clamp blocks 124' engage the periphery of the gate valve element 12.

The refinishing tool 14 is mounted on the assembly 10 by placing tool 14 through the aperture 48 of the tool support member 36 so that the tool base plate 82 of tool 14 fits snugly in aperture 48. The procedure for orienting and securing the tool base plate 82 into the tool support member 36 is described above.

After the tool 14 is mounted, the circular abrading means 76 thereof is generally in the vicinity of the wedge-shaped gate valve element 12. The distance of the tool 14 above the base plate 20, and hence the distance of the abrasive means 76 above the sloped surface 16 of the element 12, is selectively adjustable by loosening fasteners 40 using knobs 42, sliding the tool support member 36 to the desired position, and then tightening the threaded fasteners 40.

As previously discussed, the refinishing tool 14 can be adjusted in the horizontal direction (depicted by arrow 128 in FIG. 2) by loosening the second clamping means 74 from the first clamping means 72 and sliding the elongated support arm 66 of the tool 14 in the appropriate direction. Further, when the pivot pins 70 are unlocked by loosening the unillustrated locking screws, the tool 14 may be pivoted about the pins 70 in the directions indicated by arrows 130. Thus, pins 70 serve as an axis of rotation which, in the illustrated embodiments, is parallel to a line formed by the intersection of the front plate 18 and the base plate 20. In this respect, the knob 85 may be rotated upon threaded shaft 83 so that the knob 85 presses against bracket 84, thereby pivoting the housing and support means about pins 70 in the direction of arrow 130.

Due to the angle of inclination A which the support surface 90 of the support member 86 makes with the base plate 20, the vises 92 and 92' mounted thereon, and particularly the upper sloped surface 16a of the gate valve element 12, acquires a desired orientation with respect to the abrasive means 76 of the refinishing tool 14. In this respect, the sloped surface 16a of gate valve element 12 need not necessarily acquire an exact orientation with respect to the base plate 20 since the swivel joint 80 of the refinishing tool 14 allows some tolerance in the orientation of the sloped surface 16a.

Once sloped surface 16a of element 12 has been secured and centered in desired orientation with the abrasive means 76, the refinishing tool 14 is ready to refinish or grind the sloped surface 16a. After the refinishing of surface 16a is completed, the vise 92 (or 92') is relaxed so that the gate valve element 12 may be removed and turned over. The sloped surface 16b then faces the abrasive element 76 while sloped surface 16a is resting on the top surface 94 (or 94') of the appropriate vise. The gate valve element 12 is then again secured and centered with respect to the abrasive means 76 for refinishing the sloped surface 16b.

The apparatus 10 may be moved from place to place for refinishing gate valves in various locations. Fabrication of the frame 17, as well as the vises 92 and 92' and the vise support 86, from a light weight metal, such as aluminum, provides a light weight apparatus which is portable yet durable and sturdy.

While the invention has been particularly shown and described with reference to a preferred embodiment, it will be understood by those skilled in the art that various alterations in form and detail may be made therein without departing from the spirit and scope of the invention.

The embodiments of the invention in which an exclusive property or privilege is claimed are defined as follows:

1. A portable apparatus for refinishing a sloped surface of a wedge-shaped gate valve element, said apparatus comprising:

a tool having a working surface mounted thereon by a swivel joint;

frame means, said frame means comprising a first frame member lying substantially in a first plane and a second frame member lying substantially in a second plane, said second plane being substantially orthogonal to said first plane;

carriage means for holding said tool, said carriage means being selectively positionable in said first plane of said frame means so that the position of said tool is selectively adjustable with respect to said second plane, said tool being held by said carriage so that said tool may be selectively pivoted about an axis parallel to a line formed by the intersection of said first plane and said second plane;

vise means for holding said gate valve element so that said sloped surface thereof faces said tool; and, support means mounted on said second frame member and upon which said vise member is rigidly mounted, said support member having a support surface inclined at an angle with respect to said second frame member upon which it is mounted so that said sloped surface of said wedge-shaped gate valve element held in said vise means acquires a desired orientation with respect to said tool.

2. A portable apparatus for refinishing a sloped surface of a wedge-shaped gate valve element, said apparatus comprising:

a tool having a working surface mounted thereon by a swivel joint;

frame means, said frame means comprising a first frame member lying substantially in a first plane and a second frame member lying substantially in a second plane, said second plane being substantially orthogonal to said first plane;

carriage means adapted to travel in said first plane of said frame means and to hold said tool so that the position of said tool is selectively adjustable:

(1) with respect to said second plane;

(2) with respect to a first axis, said first axis being parallel to a line formed by the intersection of said first plane and said second plane, said tool being pivotable about said first axis;

(3) with respect to a second axis, said second axis being perpendicular to said first plane, said tool being rotatable about said second axis; and, (4) with respect to said first plane; and, vise means for holding said gate valve element so that said sloped surface thereof faces said tool, said vise means being mounted on said second frame member so that said wedge-shaped gate valve element held in said vise member acquires a desired orientation with respect to said tool.

3. The apparatus of claims 1 or 2, wherein said vise means comprises a disc having a plurality of radially extending grooves channeled on a circular surface thereof, wherein each of said grooves is adapted to accommodate a rotatable threaded member, and wherein each of said grooves also accommodates a clamp member, said clamp member having a bore therethrough which is counter threaded so that said clamp member travels in a radial direction on said rotatable threaded member engaged therewith, said clamp member further having a gripping portion extending from said groove beyond said circular surface of said disc for gripping said wedge-shaped gate valve element positioned on said circular surface.

4. The apparatus of claims 1 or 2, wherein at least an additional vise means is mounted on said first vise means, said additional vise means having secured thereon said gate valve element.

5. The apparatus of claim 2, further comprising support means mounted between said second frame member and said vise means, said support member having a support surface inclined at an angle with respect to said second frame member upon which it is mounted so that said sloped surface of said wedge-shaped gate element held in said vise means acquires a desired orientation with respect to said tool.

6. The apparatus of claims 1 or 5, wherein said support member is integral with said second plate and has its support surface inclined at an angle of approximately 5° with respect to said second plane.

7. The apparatus of claim 1, wherein said tool comprises a working surface oriented proximate said wedge-shaped gate valve element, and wherein the distance of said working surface from said first plane is selectively adjustable.

8. The apparatus of claims 1 or 2, further comprising:

threaded shaft means having a first end hingedly connected to said carriage means;

bracket means connected to said tool, said bracket means being pivotable about said first axis, said bracket means being adapted to have said threaded shaft means extend therethrough; and stop means adapted to engage a second end of said threaded shaft means and thereby limit the extent of travel of said bracket means along said threaded shaft means.

* * * * *